US005127821A

United States Patent [19]

Keller

[11] Patent Number: 5,127,821

[45] Date of Patent: Jul. 7, 1992

[54] PREMIXING BURNER FOR PRODUCING HOT GAS

[75] Inventor: Jakob Keller, Dottikon, Switzerland

[73] Assignee: Asea Brown Boveri Ltd., Baden, Switzerland

[21] Appl. No.: 511,233

[22] Filed: Apr. 19, 1990

[30] Foreign Application Priority Data

Apr. 24, 1989 [CH] Switzerland ..... 1546/89-7

[51] Int. Cl.[5] ..... F23C 5/00

[52] U.S. Cl. ..... 431/10; 431/8; 431/9; 431/350; 431/115; 431/182; 431/183; 431/351; 431/352

[58] Field of Search ..... 431/2, 115, 116, 4, 431/8, 9, 11, 10, 12, 173, 182, 187, 188, 278, 242, 239, 350, 351, 353; 60/39, 464, 743; 110/264, 347

[56] References Cited

U.S. PATENT DOCUMENTS

| | | | |
|---|---|---|---|
| 2,881,719 | 4/1959 | Sifrin | 431/173X |
| 3,012,402 | 12/1961 | Probert et al. | 110/264 |
| 3,868,211 | 2/1975 | Haye et al. | 431/10 |
| 4,023,921 | 5/1977 | Anson | 431/115 X |
| 4,781,030 | 11/1988 | Hellat et al. | 60/743 |
| 4,815,966 | 3/1989 | Janssen | 431/115 |
| 4,932,861 | 6/1990 | Keller et al. | 431/8 |

FOREIGN PATENT DOCUMENTS

| | | | |
|---|---|---|---|
| 0210462 | 2/1987 | European Pat. Off. . | |
| 0321809 | 6/1989 | European Pat. Off. . | |
| 413283 | 5/1925 | Fed. Rep. of Germany | 431/173 |
| 315466 | 7/1929 | United Kingdom | 110/262 |
| 2043869 | 10/1980 | United Kingdom . | |

*Primary Examiner*—Carl D. Price

*Attorney, Agent, or Firm*—Burns, Doane, Swecker & Mathis

[57] ABSTRACT

In a premixing burner, which consists of two hollow partial conical bodies (1, 2), which are positioned on one another and have a cone inclination increasing in the direction of flow, the fuel feed takes place via central fuel nozzle (3) and/or via a plurality of fuel nozzles (17), which are placed along the inflow of the combustion air (15) into the interior (14) of the burner. The combustion air (15) itself is a mixture of fresh air and exhaust gas. The fresh air is led up via a first flow funnel (23*a*, 23*b* ) and exhaust gas recirculation takes place via a second flow funnel (22*a*, 22*b*). These two gases mix with one another before flowing tangentially into the interior (14). An optimum, homogenous fuel concentration over the cross-section arises in the region of the return flow zone (6).

9 Claims, 3 Drawing Sheets

PREMIXING BURNER FOR PRODUCING HOT GAS

BACKGROUND OF THE INVENTION

1. Field of the invention

The present invention relates to a premixing burner for producing hot gas in accordance with the preamble of claim 1. It also relates to a method of operating such a premixing burner.

2. Discussion of Background

A burner has become known from EP-A1-0,210,462 which is formed from at least two double cambered, hollow partial conical bodies, each charged by a tangential air inlet. In the direction of flow, these bodies develop away from one another along diagonals opening in the manner of conical rays. In this process, one cambered body forms an inner cone with a conical opening increasing in the direction of outward flow, while the other cambered body forms an outer cone with a conical opening decreasing in the direction of outward flow. At their ends, the inner cones carry on their entire axial extent one fuel pipeline each for feeding the gaseous fuel, which flows through a plurality of fuel nozzles into the interior of the burner, in order to mix there with the tangentially inflowing combustion air. Moreover, the burner has a separate feed of a liquid fuel, so that we are dealing here with a dual burner. Injection of the liquid fuel is directed axially onto the outer cones in such a way that, depending upon the intensity of the injection, a fuel film of different length and consistency forms there. Apart from the natural evaporation of the liquid fuel due to the radiant heat prevailing there, a significant mixing of fuel comes about due to the tangentially led up combustion air, which due to its swirling motion in the axial direction rolls up the fuel film in layers, so that the production of a strong vortex mixing becomes superfluous. Due to the fact that the impulse of the injection of the liquid fuel is matched to the machine load, the mixture is never too lean or too fat. It is thus possible to achieve the following immediately:

The advantages of a burner with a premixing section, namely little $NO_x$ and CO, arise, so that we are dealing here with a premixing burner.

Good flame stability is guaranteed in a wide operating range, so that it is possible to abandon measures against a flame kickback in the interior of the burner. Moreover, the design configuration of this burner produces an eddying flow which, on the one hand, is low in angular momentum in the center but, on the other hand, has an excess of axial velocity. Because the swirl coefficient increases strongly in the axial direction and reaches the breakdown value at the end of the burner, this produces a vortex return flow which is positionally stable.

SUMMARY OF THE INVENTION

Accordingly, one object of this invention, as it is specified in the claims, is to develop a burner of the type mentioned at the beginning in order to minimize even further the pollutant emission values at each operation, in connection with operation both with liquid and with gaseous fuels, and in the case of a mixed operation with both.

A substantial advantage of the invention is to be seen in that the use of exhaust gas recirculation simultaneously affects the evaporation of fuel and the flame temperature in the combustion chamber. If the burner is operated with liquid fuel, the exhaust gas recirculation, which thermally prepares the combustion air, ensures that a completely evaporated fuel/combustion air mixture can be fed to the combustion. This optimization of the mixture, which is occasioned by the exhaust gas recirculation, then also influences the flame temperature in the combustion chamber in such a way that local peak temperatures which are responsible for the formation of $NO_x$, no longer occur there. If, by contrast, the burner is operated with gaseous fuel, although a gaseous mixture is already present the flame temperature experiences here, too, that positive influence previously described. In the case of a mixed operation with liquid and gaseous fuel, the advantages of the exhaust gas recirculation come to bear simultaneously.

With regard to pollutant emissions, a burner operated in such a fashion has improvements which are not restricted only to a few percentage points, but $NO_x$, emissions alone are minimized in such a way that perhaps only 10% of that is measured which is tolerated by the statutory limits. Consequently, an entirely new level of quality is achieved in this way. A further advantage of the invention is to be seen in that due to the exhaust gas recirculation the possibility now exists of operating atmospheric combustion installations optimally with respect to pollutant emissions in a near-stoichiometric mode.

A further advantage of the invention is based on a preferred embodiment of the burner. Despite the simplest geometrical embodiment, there must be no fear here either of a danger of flashback of the flame from the combustion chamber into the burner. The well known problems in the use of swirlers in a mixed flow, for example those that can arise from the burning up of coatings with destruction of the swirl vanes, thus do not occur here. The improvement in relation to pollutant emissions is also maintained.

Advantageous and expedient further developments of the achievement of the objects according to the invention are specified in the further dependent claims.

BRIEF DESCRIPTION OF THE DRAWINGS

A more complete appreciation of the invention and many of the attendant advantages thereof will readily obtained as the same becomes better understood by reference to the following detailed description when considered in connection with the accompanying drawings, in which all elements not required for the immediate understanding of the invention are omitted, and wherein.

DESCRIPTION OF THE PREFERRED EMBODIMENTS

Figure 1:
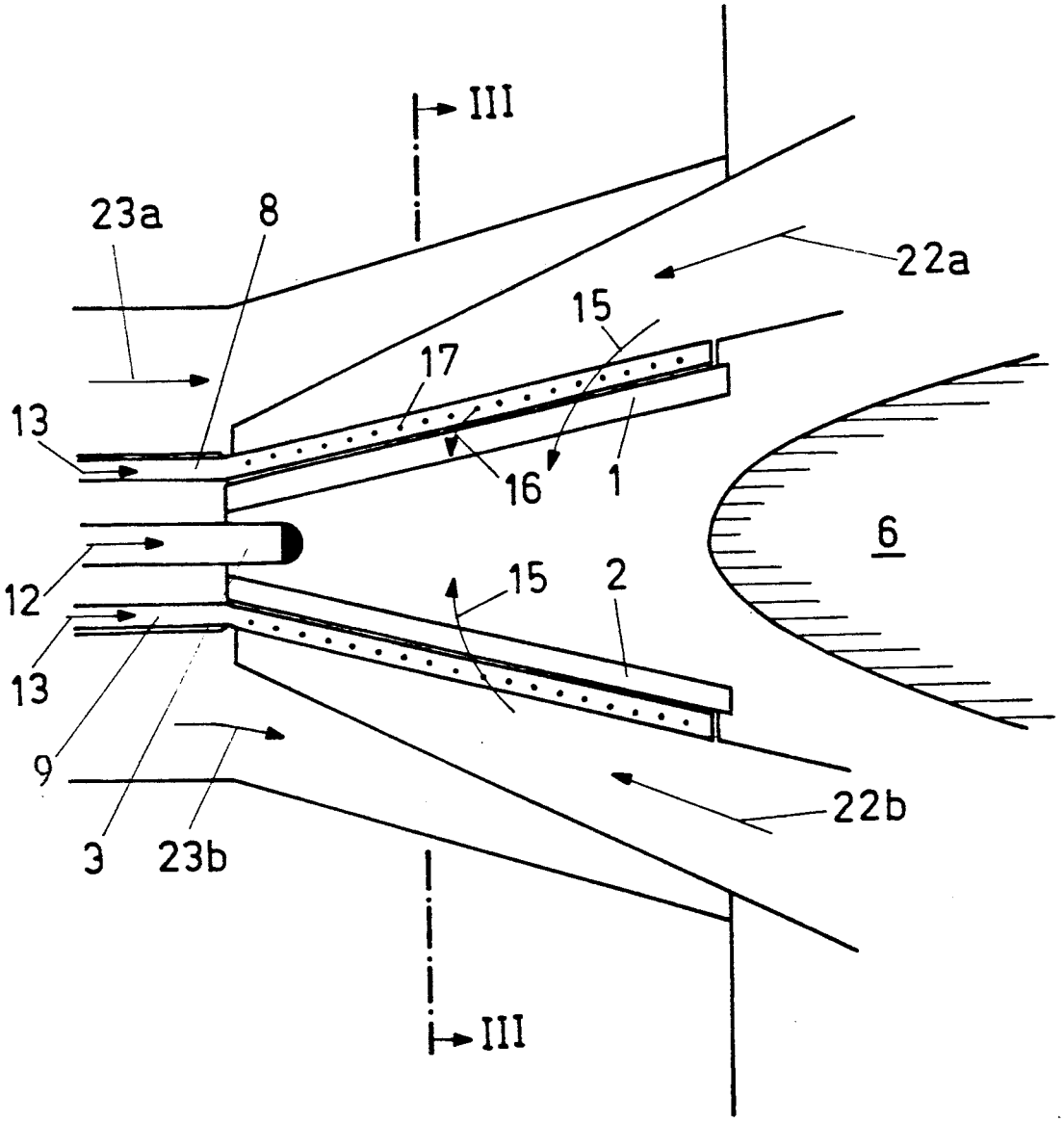
FIG. 1 shows a diagrammatic representation of the complete burner.
Figure 2:
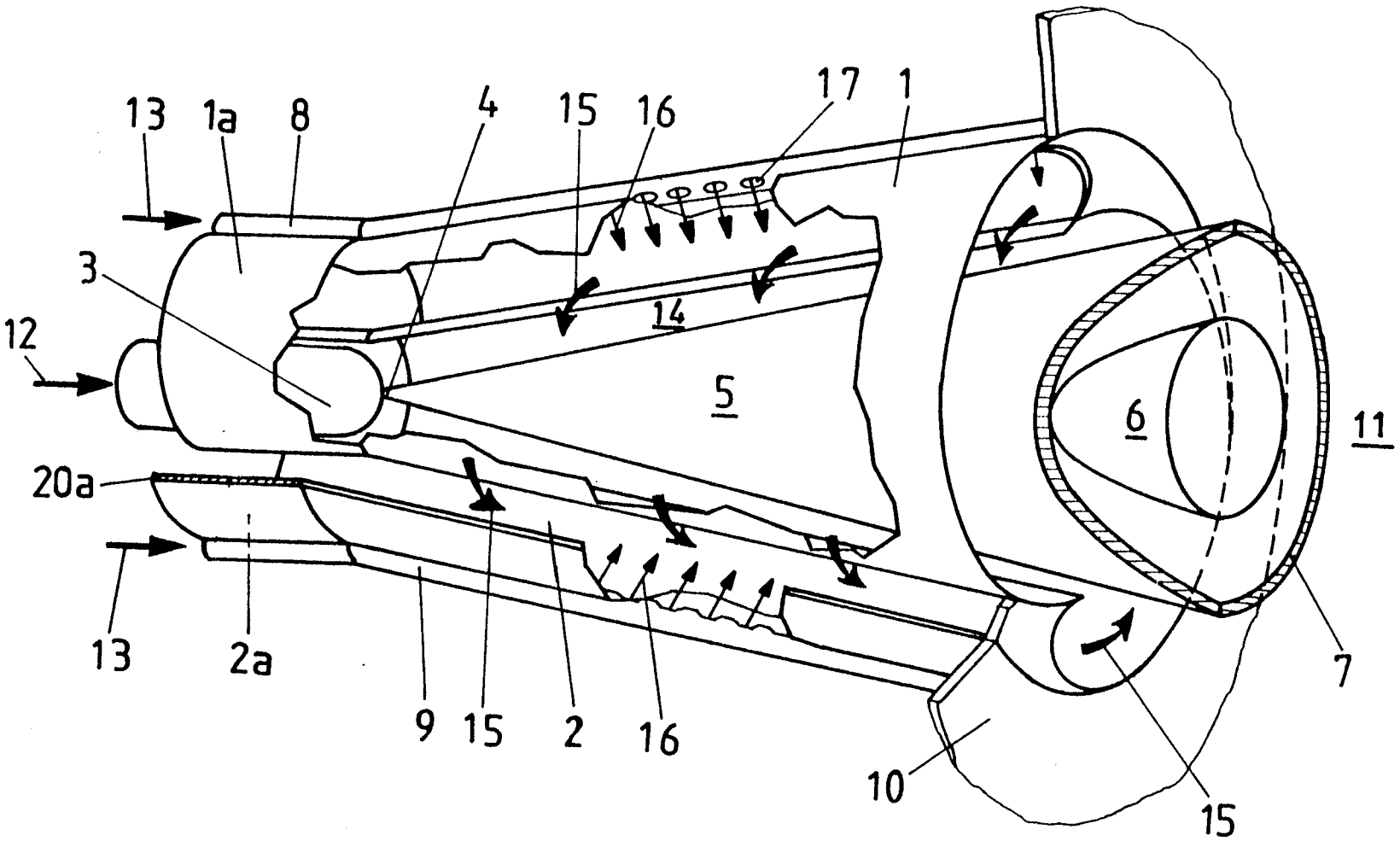
FIG. 2 shows a perspective representation of the burner body, cut away appropriately, the tangential air feed being represented.
Figure 3:
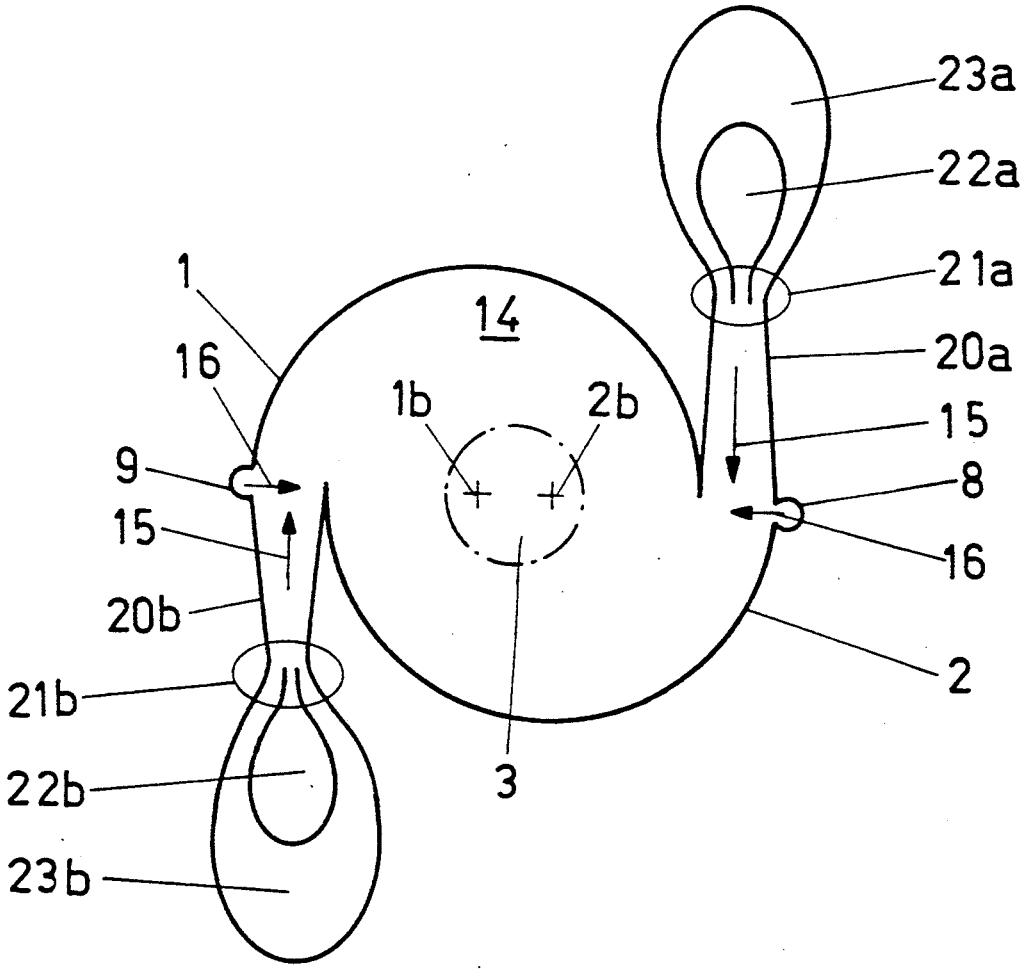
FIG. 3 shows a diagrammatic representation of the air feed and exhaust gas recirculation as the section III—III from FIG. 1.

Referring now to the drawings, wherein like reference numerals designate identical or corresponding parts throughout the several views, it is advantageous for a better understanding of the construction of the burner if when reading the illustrative embodiment of the invention described here FIGS. 1-3 are adduced simultaneously; in order not to clutter up the individual figures unnecessarily, individual partial aspects of the burner are distributed over different figures, the directions of flow of the different media being specified by arrows. Attention is drawn to this state of affairs in the description of the individual figures.

As a diagrammatic representation of the subject matter, FIG. 1 shows only the basic construction of the burner. The burner body consists of two hollow half partial conical bodies 1, 2, which, as then emerges subsequently from FIG. 2, are arranged mutually offset on one another. In view of this geometrical construction, the term "double cone burner" is used below. A nozzle 3 ensures feeding of the liquid fuel 12; the two partial conical bodies 1, 2 each have a fuel pipeline 8, 9 that are provided with openings 17, through which the gaseous fuel 13 flows, in order then to mix with the combustion air 15. This combustion air 15 is, as may be seen from FIG. 3, an air/exhaust gas mixture. This air/exhaust gas mixture arises from a fresh air feed 23*a*, 23*b* and an exhaust gas 22*a*, 22*b*, which originates from the combustion in the double cone burner. The advantages of such exhaust gas recirculation are considered in more detail with reference to FIG. 3. Reference should be made to the description of FIG. 2 for the particulars of the diagrammatically represented return flow zone 6.

The core body of the double cone burner in accordance with FIG. 2 consists of two hollow half partial conical bodies 1, 2, which are arranged mutually offset on one another. The mutual offset of the respective central axis 1*b*, 2*b* of the partial conical bodies 1, 2 uncovers on both sides in a mirror arrangement one tangential air inlet each (see FIG. 3), through which combustion air 15 flows into the interior of the double cone burner, i.e. into the conical cavity 14. The two partial conical bodies 1, 2 each have a cylindrical initial part 1*a*, 2*a*, which likewise extend, in a manner analogous to the partial conical bodies 1, 2, in a mutually offset fashion, so that the tangential air inlets are present from the beginning. Accommodated in his cylindrical initial part 1*a*, 2*a* is a nozzle 3, of which the fuel injection 4 coincides with the narrowest cross-section of the conical cavity 14 formed by the two partial conical bodies 1, 2. The size of this nozzle 3 conforms to the type of burner. It is, of course, possible for the double cone burner to be embodied purely conically, that is to say without cylindrical initial parts 1*a*, 2*a*. Both partial conical bodies 1, 2 each have a fuel pipeline 8, 9 that are provided with fuel nozzles 17, through which flows the gaseous fuel 13, which is mixed with the combustion air 15 flowing through the tangential air inlets. As to the position of these fuel pipelines 8, 9, they are fitted at the end of the tangential air inlets, so that there, too, mixing 16 of this fuel 13 with the inflowing combustion air 15 can take place. A mixed operation with both types of fuel is, of course, possible. On the combustion chamber side 22, the double cone burner has a plate which forms the boiler wall 10. The liquid fuel 12 flowing through the nozzle 3 is injected at an acute angle into the conical cavity 14 in such a way that as homogenous and conical a fuel spray as possible arises in the burner exit plane. The fuel injection 3 can be an air-supported nozzle or a dual burner with gaseous and liquid fuel feed, as is described in EP-A1,210,462,. The conical liquid fuel profile 5 from the nozzle 3 is now surrounded in a rotating fashion by the tangentially inflowing combustion air 15. The concentration of the liquid fuel 12 is continuously reduced in the axial direction by the inflowing combustion air 15. If gaseous fuel 13 is injected 16, the formation of the mixture with the combustion air 15 takes place directly at the end of the tangential air inlets. When the liquid fuel 12 is injected, the optimum, homogeneous fuel concentration over the cross-section is achieved in the region where the vortex breaks down, that is to say in the region of the return flow zone 6, in that the vortex flow imposes an angular velocity component on the fuel droplets produced by the oil nozzle. The centrifugal force thereby produced drives the droplets of the liquid fuel 12 radially outwards. However, evaporation acts at the same time. In the case under discussion, the result of the interplay of centrifugal force and evaporation is that the inner walls of the partial conical bodies 1, 2 are not wetted, and that a very uniform fuel-air mixture comes about in the region of the return flow zone 5. The ignition itself takes place at the peak of the return flow zone 6; it is not until this point that a stable flame front 7 can arise. Here, there would be no fatal consequences of a kickback of the flame into the interior of the burner, as is always to be feared in the case of known premixing sections, where remedy is sought, however, against this with complicated flame retention baffles. The degree of evaporation is, of course, dependent upon the size of the burner, the drop size distribution in the case of liquid fuel, and the temperature of the combustion air 15. In the case of complete evaporation before entry into the combustion zone, the pollutant emission values are at their lowest. Narrow limits are to be observed in the configuration of the partial conical bodies 1, 2 with respect to the cone inclination and the width of the tangential air inlets, in order that for the purpose of flame stabilization the desired flow field of the air with its return flow zone 6 arises in the region of the burner aperture. It may be said in general that a reduction in size of the tangential air inlets displaces the return flow zone 6 further upstream, which would then mean, however, the mixture igniting earlier. Nevertheless, it can be established here that, once fixed geometrically, the return flow zone 6 is positionally stable per se, because the swirl coefficient increases in the direction of flow in the region of the conical form of the burner. The design of this double cone burner is eminently suitable, in the case of a predetermined overall burner length, for changing the size of the tangential air inlets, in that the partial conical bodies 1, 2 are fixed to the boiler wall 10 with the aid of a detachable connection. Displacing the two partial conical bodies 1, 2 radially towards or away from one another reduces or increases the spacing of the two central axes 1*b*, 2*b*, and there is a corresponding change in the gap width of the tangential air inlets, as may be understood particularly well from FIG. 3.

FIG. 2 merely indicates one inlet 20*a*, which guides the combustion air 15 tangentially into the cavity 14. The other inlet 20*b*, which is not visible, as well as the overall configuration of the same follow from FIG. 3.

FIG. 3 is a section approximately in the middle of the double cone burner in accordance with the plane of section III—III from FIG. 1. The mirror-tangentially arranged inlets 20*a*, 20*b* are constructed as diffusors, something which is done to amplify the effect of the jet injector 21*a*, 21*b* provided, in each case, at the start of the diffusor. As a continuation of the inlets 20*a*, 20*b*, the air feed channel 23*a*, 23*b* contains an exhaust gas return funnel 22*a*, 22*b*, whose outlet coincides with the plane of action of the jet injector 21*a*, 21*b*. It follows from this that the combustion gas 15 is an air/exhaust gas mixture, as has already been mentioned briefly with reference to FIG. 1. This recirculation of an amount of partially cooled exhaust gas with a temperature of approximately 950° C. is necessary for optimum operation of the double cone burner if the latter is employed in atmospheric combustion installations in the case of a near-stoichiometric mode of operation. The optimum mass flow ratio, i.e. the ratio between recirculated exhaust gas and fresh air fed in, is approximately 0.7. At a fresh air temperature of 15° C. for example, and an exhaust gas temperature of approximately 950° C., a mixing temperature of the air/exhaust gas mixture 15 of approximately 400° C. is achieved. In the case of a double cone burner with a thermal output of approximately 100–200 KW, these relationships lead to optimum evaporation conditions for the liquid fuel and to a minimization of the $NO_x$/-CO/UHC emissions.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. A method of operating a premixing burner comprising the steps of:

forming a conical column of liquid fuel substantially within a burner body, said burner body being formed of at least two hollow partial conical bodies mated together in an offset relationship;

supplying combustion air to tangential air inlet slots positioned substantially along the length of said burner body;

supplying recirculated exhaust air to said tangential air inlet slots;

supplying said combustion air to said air inlet slots through a first funnel and supplying said recirculated exhaust gas to said air inlet slots through a second funnel, said second funnel being substantially contained within said first funnel and each funnel extending substantially the length of said burner body, and mixing said combustion air with said recirculated exhaust air such that an air/exhaust gas mixture is introduced into the interior of said burner body.

2. The method as claimed in claim 1, wherein the ratio between the recirculated exhaust gas and the combustion air is approximately 0.7.

3. A method of operating a premixing burner according to claim 1 further comprising the step of introducing gaseous fuel into said burner body through a plurality of nozzles positioned along said air inlet slots.

4. A method of operating a premixing burner according to claim 1, wherein said combustion air and said recirculated exhaust gas is supplied to said tangential air inlet slots through an injector/diffuser arrangement.

5. A premixing burner for producing hot gas comprising:

at least two hollow partial conical bodies mated together in an offset relationship to form a burner body;

tangential air inlet slots for introducing combustion air into the interior of said burner body, said air inlet slots extending substantially the length of said burner body;

nozzle means for supplying a conical column of liquid fuel within said burner body substantially along the length of said burner body;

means for mixing exhaust air with said combustion air to form an air/exhaust gas mixture that is introduced through said air inlet slots into said burner body;

said means for mixing including first funnel means for directing combustion air flow and second funnel means for directing exhaust air flow, a portion of said second funnel means being substantially contained within said first funnel means;

said first and second funnel means each extending substantially along the length of said air inlet slots and each having an aperture in substantial alignment with said air inlet slots.

6. A premixing burner according to claim 5, further comprising a plurality of nozzle means for supplying gaseous fuel to said interior of said burner body through said tangential air inlet slots, said plurality of nozzle means being positioned at said air inlet slots substantially along the length of said burner body.

7. A premixing burner according to claim 6, wherein each aperture of said first and second funnel means has a convergent shape such that an injector effect is imparted to fluid flow exiting from said first and second funnel means.

8. A premixing burner according to claim 5, wherein said air inlet slots are formed from two opposing walls oriented to diverge from each other such that a diffuser effect is imparted to fluid flow received from said first and second funnel means.

9. The premixing burner as claimed in claim 5, wherein said fuel nozzle is located centrally with respect to mutually offset central axes of said partial conical bodies.

* * * * *